US006385793B1

(12) United States Patent
Sanddal

(10) Patent No.: US 6,385,793 B1
(45) Date of Patent: May 14, 2002

(54) TUB COVER SUPPORT DEVICE

(76) Inventor: Robert Sanddal, 10 Las Piedras, Rancho Santa Margarita, CA (US) 92688

( * ) Notice: Subject to any disclaimer, the term of this patent is extended or adjusted under 35 U.S.C. 154(b) by 0 days.

(21) Appl. No.: 09/765,655

(22) Filed: Jan. 22, 2001

(51) Int. Cl.[7] ..... A47K 3/02

(52) U.S. Cl. ..... 4/580; 248/205.5; 248/683

(58) Field of Search ..... 4/498, 503, 580, 4/504, 255.11, 496, 488; 248/205.5, 206.2, 683, 363, 158, 169, 188.1, 125.1, 124.1; 135/96, 98, 99

(56) References Cited

U.S. PATENT DOCUMENTS

| | | | | | |
|---|---|---|---|---|---|
| 674,197 | A | * | 5/1901 | Cooper | 4/255.01 |
| 1,595,034 | A | * | 8/1926 | Trautschold | 182/179.1 |
| 3,521,416 | A | | 7/1970 | Joor, II | |
| 3,604,019 | A | * | 9/1971 | Garner | 4/576.1 |
| 4,776,046 | A | * | 10/1988 | Newberry et al. | 4/541 |
| 4,951,327 | A | | 8/1990 | Del Gorio, Sr. | |
| D331,737 | S | | 12/1992 | Duport | |
| 5,303,527 | A | | 4/1994 | Perez et al. | |
| 5,477,876 | A | * | 12/1995 | Moss | 135/97 |
| 5,517,702 | A | | 5/1996 | Fraher | |
| 5,524,296 | A | * | 6/1996 | Leighton | 4/255.05 |
| 5,651,914 | A | | 7/1997 | Schworer | |
| 6,059,010 | A | * | 5/2000 | Yang | 160/370.22 |
| 6,223,358 | B1 | * | 5/2001 | DePietro | 4/498 |

* cited by examiner

*Primary Examiner*—Gregory L. Huson
*Assistant Examiner*—Huyen Le

(57) ABSTRACT

A tub cover support device for preventing the collapsing of a tub cover. The tub cover support device includes a foot for positioning on the bottom wall of a tub. A pipe is generally hollow and has an open first end and open second end. A coupler is attached to the foot and removably couples the first end of the pipe to the foot. A support portion is removably coupled to the second end of the pipe. The support portion has a pair of bars extending outward horizontally with respect to a vertical orientation of the pipe when the support portion is coupled to the second end of the pipe. A bottom surface of a cover abuts the support portion when the cover is positioned over an open top side of the tub.

11 Claims, 2 Drawing Sheets

TUB COVER SUPPORT DEVICE

BACKGROUND OF THE INVENTION

1. Field of the Invention

The present invention relates to tub cover support devices and more particularly pertains to a new tub cover support device for preventing the collapsing of a tub cover.

2. Description of the Prior Art

The use of tub cover support devices is known in the prior art. More specifically, tub cover support devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,951,327; 5,303,527; 5,517,702; 3,521,416; U.S. Pat. No. Des. 331,737; and U.S. Pat. No. 5,651,914.

While these devices fulfill their respective, particular objectives and requirements, the aforementioned patents do not disclose a new tub cover support device. The inventive device includes a foot for positioning on the bottom wall of a tub. A pipe is generally hollow and has an open first end and open second end. A coupler is attached to the foot and removably couples the first end of the pipe to the foot. A support portion is removably coupled to the second end of the pipe. The support portion has a pair of bars extending outward horizontally with respect to a vertical orientation of the pipe when the support portion is coupled to the second end of the pipe. A bottom surface of a cover abuts the support portion when the cover is positioned over an open top side of the tub.

In these respects, the tub cover support device according to the present invention substantially departs from the conventional concepts and designs of the prior art, and in so doing provides an apparatus primarily developed for the purpose of preventing the collapsing of a tub cover.

SUMMARY OF THE INVENTION

In view of the foregoing disadvantages inherent in the known types of tub cover support devices now present in the prior art, the present invention provides a new tub cover support device construction wherein the same can be utilized for preventing the collapsing of a tub cover.

The general purpose of the present invention, which will be described subsequently in greater detail, is to provide a new tub cover support device apparatus and method which has many of the advantages of the tub cover support devices mentioned heretofore and many novel features that result in a new tub cover support device which is not anticipated, rendered obvious, suggested, or even implied by any of the prior art tub cover support devices, either alone or in any combination thereof.

To attain this, the present invention generally comprises a foot for positioning on the bottom wall of a tub. A pipe is generally hollow and has an open first end and open second end. A coupler is attached to the foot and removably couples the first end of the pipe to the foot. A support portion is removably coupled to the second end of the pipe. The support portion has a pair of bars extending outward horizontally with respect to a vertical orientation of the pipe when the support portion is coupled to the second end of the pipe. A bottom surface of a cover abuts the support portion when the cover is positioned over an open top side of the tub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tub cover support device apparatus and method which has many of the advantages of the tub cover support devices mentioned heretofore and many novel features that result in a new tub cover support device which is not anticipated, rendered obvious, suggested, or even implied by any of the prior art tub cover support devices, either alone or in any combination thereof.

It is another object of the present invention to provide a new tub cover support device which may be easily and efficiently manufactured and marketed.

It is a further object of the present invention to provide a new tub cover support device which is of a durable and reliable construction.

An even further object of the present invention is to provide a new tub cover support device which is susceptible of a low cost of manufacture with regard to both materials and labor, and which accordingly is then susceptible of low prices of sale to the consuming public, thereby making such tub cover support device economically available to the buying public.

Still yet another object of the present invention is to provide a new tub cover support device which provides in the apparatuses and methods of the prior art some of the advantages thereof, while simultaneously overcoming some of the disadvantages normally associated therewith.

Still another object of the present invention is to provide a new tub cover support device for preventing the collapsing of a tub cover.

Yet another object of the present invention is to provide a new tub cover support device which includes a foot for positioning on the bottom wall of a tub. A pipe is generally hollow and has an open first end and open second end. A coupler is attached to the foot and removably couples the first end of the pipe to the foot. A support portion is removably coupled to the second end of the pipe. The support portion has a pair of bars extending outward horizontally with respect to a vertical orientation of the pipe when the support portion is coupled to the second end of the pipe. A bottom surface of a cover abuts the support portion when the cover is positioned over an open top side of the tub.

Still yet another object of the present invention is to provide a new tub cover support device that is retrofittable to existing tub and cover combinations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
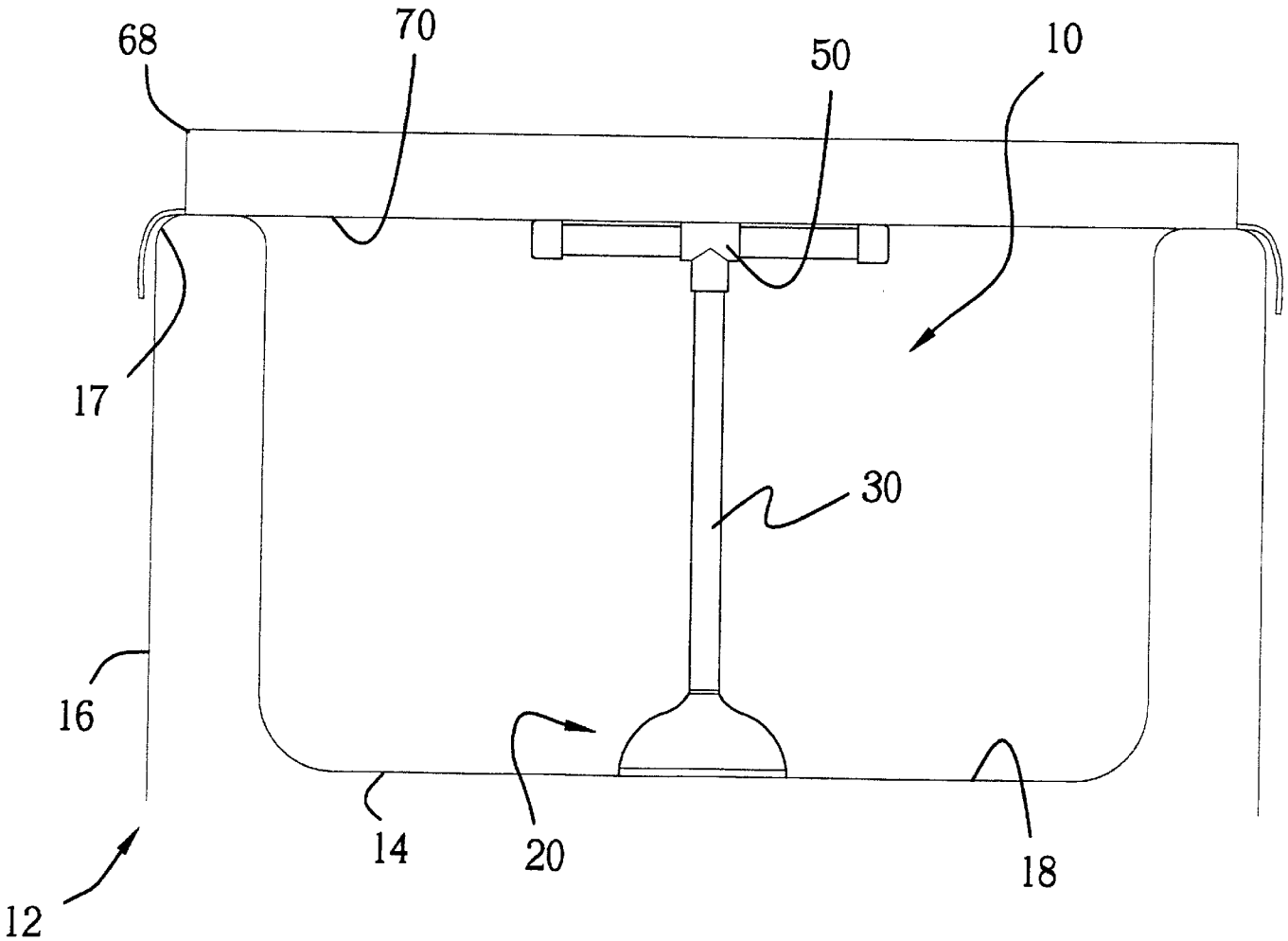
FIG. 1 is a schematic side view of a new tub cover support device according to the present invention.
Figure 2:
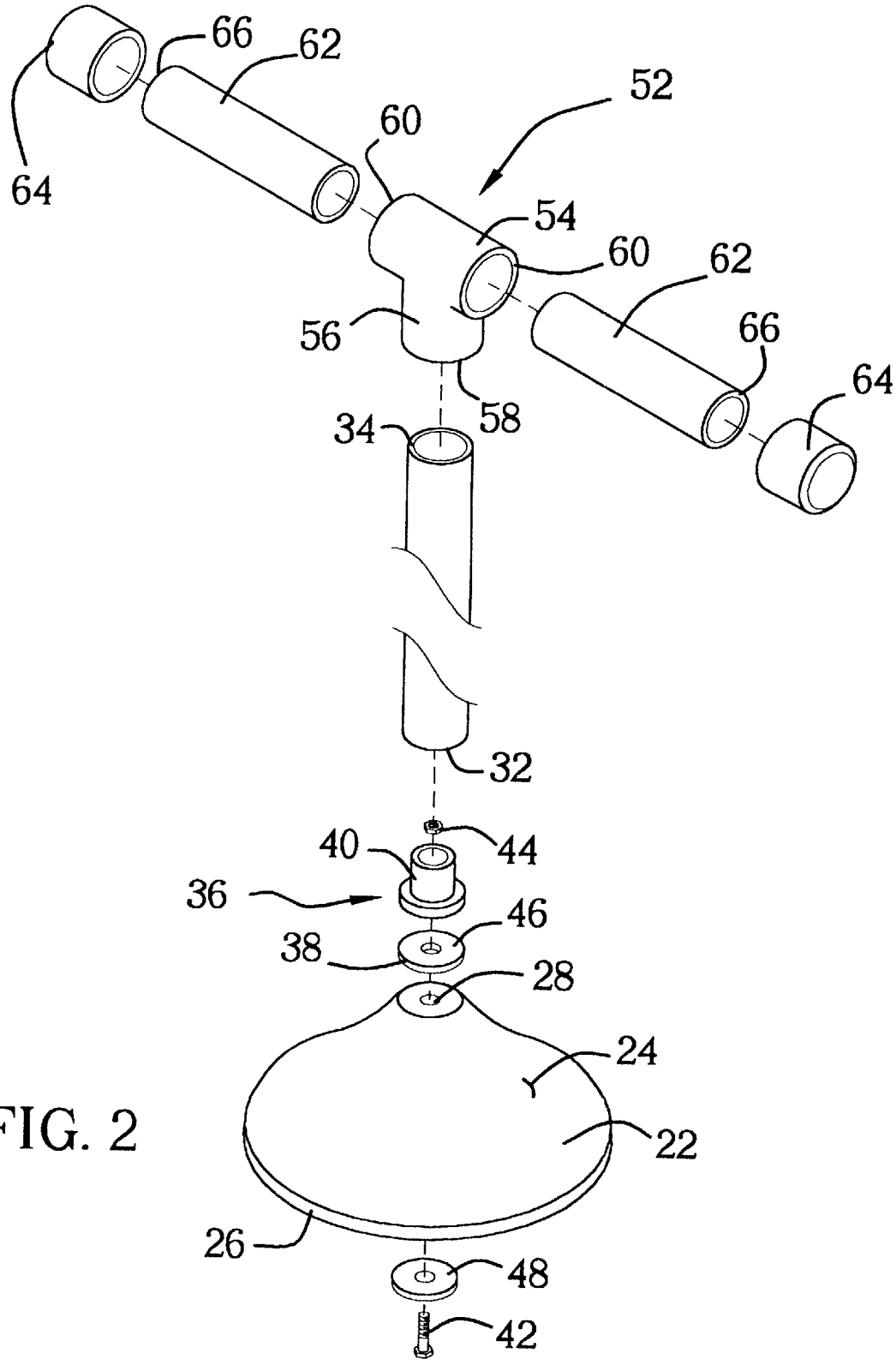
FIG. 2 is a schematic perspective view of the present invention.

With reference now to the drawings, and in particular to FIGS. 1 and 2 thereof, a new tub cover support device embodying the principles and concepts of the present invention and generally designated by the reference numeral 10 will be described.

As best illustrated in FIGS. 1 and 2, the tub cover support device 10 generally comprises a tub 12 having a bottom wall 14 and a peripheral wall 16 attached to and extending upwardly from the bottom wall 14. The bottom wall 14 has an interior surface 18. The tub 12 is a conventional hot tub or spa.

A foot 20 for positioning in the tub on the bottom wall comprises a suction cup and includes a panel 22 having a concave outer surface 24 extending to a bottom edge 26. The panel 22 comprises an elastomeric material. A central portion of the panel 22 has an opening 28 therein extending through the panel 22.

A pipe 30 is generally hollow and has an open first end 32 and open second end 34. The pipe 30 has a length preferably between 30 inches and 40 inches, although variations in length as well as a telescoping pipe are envisioned. The pipe 30 is preferably comprised of a plastic material.

A coupler 36 is attached to the suction cup and removably couples the pipe 30 to an apex of the outer surface 24 of the suction cup, or foot 20. The coupler 36 includes a disc 38 having a tubular member 40 attached to and extending upwardly from a first side of the disc 38. The tubular member 40 has a diameter substantially equal to an inner diameter of the first end 32 of the pipe 30.

A fastener 42 is positioned in an interior of the suction cup 20 and extends upwardly through the opening 28 in the suction cup 20. The fastener 42 extends through the disc 38 and into the tubular member 40. The fastener 42 preferably comprises a screw or bolt. A nut 44 is positioned in the tubular member 40 and is threadably engaged to the fastener 42.

Ideally, a first gasket 46 is positioned between the disc 38 and the suction cup 20 such that the fastener 42 extends through the first gasket 46. The first gasket 46 comprises an elastomeric material. A second gasket 48 is positioned in the suction cup 20 such that the fastener 42 extends through the second gasket 48. The second gasket 48 comprises an elastomeric material. The gaskets 46, 48 ensure a seal around the opening 28 in the suction cup 20. The tubular member 40 is removably extended into the first end of the pipe and frictionally engages the tubular member 40.

A support portion 50 is removably coupled to the second end 34 of the pipe 30. The support portion 50 includes a bracket 52 having a first rod 54 attached to a second rod 56 at a generally perpendicular orientation wherein the second rod 56 is positioned between a pair of ends of the first rod 54 such that the bracket 52 generally has a T-shape. The first 54 and second 56 rods each have open free ends 58, 60. An inner diameter of the free end 58 of the second rod 56 is greater than an outer diameter of the second end 34 of the pipe 30 such that the second end 34 of pipe 30 may be removably extended into the free end 58 of the second rod 56.

Each of pair of bars 62 is movably extended into one of the ends 60 of the first rod 54 and frictionally engages the first rod 54. Each of the bars 62 has a length generally between 12 inches and 18 inches. Each of a pair of caps 64 is removably positioned over a free end 66 of one of the pair of bars 62.

A tub cover 68 is positioned on a top edge 17 of the peripheral wall 16 and covers an open top side of the tub 12. A bottom surface 70 of the tub cover 68 abuts the bars 62 such that the tub cover 68 is supported above a central area of a plane of the open top side of the tub. The tub cover 68 being a conventional tub cover which is relatively rigid.

In use, the foot 20 is suctioned on the bottom wall 14 of the tub 12 to retain the pipe 30 in a generally vertical orientation. The cover 68 is positioned over the tub 12 so that the support member 50 is abutting the bottom surface 70 of the cover 68. The support device 10 prevents the cover 68 from sagging so that it retains its natural orientation to prevent accumulation of snow and leaves on a top surface of the cover 68. The support device 10 will also prevent collapsing of the cover 68 should a large amount of snow accumulate on the cover. The length of the pipe 30 may be selected depending on the depth of the tub 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tub cover support device for positioning on the bottom wall of a tub, the tub having a peripheral wall extending upwardly from bottom wall, a cover being positioned on a top edge of the peripheral wall and generally covering an open top side of the tub, the device supporting said cover above a central area of a plane of the open top side, said device including:

a foot for positioning in said tub on said bottom wall, said foot comprising a suction cup including a panel having a concave outer surface extending to a bottom edge, said panel comprising an elastomeric material, a central portion of said panel having an opening therein extending through said panel;

a pipe being generally hollow and having an open first end and open second end;

a coupler being attached to said foot and removably coupling said first end of said pipe to said foot, said coupler including;

a disc having a tubular member attached to and extending upwardly from a first side of said disc, said tubular member having a diameter substantially equal to an inner diameter of said first end of said pipe;

a fastener being positioned in an interior of said suction cup and extending upwardly through said opening in said suction cup, said fastener extending through said disc and into said tubular member, said fastener comprising a screw;

a nut being positioned in said tubular member and being threadably engaged with said fastener; and wherein said tubular member is removably extended into said first end of said pipe; and a support portion being removably coupled to said second end of said pipe, said support portion having a pair of bars extending outwardly horizontally with respect to a vertical orientation of said pipe when said support portion is coupled to said second end of said pipe, wherein said bottom surface of said cover abuts said support portion.

2. The tub cover support device as in claim 1, wherein said coupler further includes:

a first gasket being positioned between said disc and said suction cup such that said fastener extends through said first gasket, said first gasket comprising an elastomeric material;

a second gasket being positioned in said suction cup such that said fastener extends through said second gasket, said second gasket comprising an elastomeric material.

3. The tub cover support device as in claim 1, wherein said pipe has a length generally between 30 inches and 40 inches.

4. The tub cover support device as in claim 1, wherein said support portion includes a bracket having a first rod attached to a second rod at a generally perpendicular orientation wherein said second rod is positioned between a pair of ends of said first rod such that said bracket generally has a T-shape, said first and second rod each having open free ends, an inner diameter of said free end of said second rod being greater than an outer diameter of said second end of said pipe such that said second end of pipe may be removably extended into said free end of said second rod, each of said bars being movably extended into one of the ends of said first rod and frictionally engaging said first rod, each of said bars having a length generally between 12 inches and 18 inches.

5. A tub cover support system including:

a tub having a bottom wall and a peripheral wall attached to and extending upwardly from the bottom wall, said bottom wall having an interior surface;

a foot for positioning in said tub on said bottom wall, said foot comprising a suction cup including a panel having a concave outer surface extending to a bottom edge, said panel comprising an elastomeric material, a central portion of said panel having an opening therein extending through said panel;

a pipe being generally hollow and having an open first end and open second end, said pipe having a length generally between 30 inches and 40 inches, said pipe comprising a plastic material;

a coupler being attached to said suction cup and removably coupling said pipe to an apex of said outer surface of said suction cup, said coupler including;

a disc having a tubular member attached to and extending upwardly from a first side of said disc, said tubular member having a diameter substantially equal to an inner diameter of said first end of said pipe;

a fastener being positioned in an interior of said suction cup and extending upwardly through said opening in said suction cup, said fastener extending through said disc and into said tubular member, said fastener comprising a screw;

a nut being positioned in said tubular member and being threadably engaged with said fastener;

a first gasket being positioned between said disc and said suction cup such that said fastener extends through said first gasket, said first gasket comprising an elastomeric material;

a second gasket being positioned in said suction cup such that said fastener extends through said second gasket, said second gasket comprising an elastomeric material;

wherein said tubular member is removably extended into said first end of said pipe;

a support portion being removably coupled to said second end of said pipe, said support portion including;

a bracket having a first rod attached to a second rod at a generally perpendicular orientation wherein said second rod is positioned between a pair of ends of said first rod such that said bracket generally has a T-shape, said first and second rod each having open free ends, an inner diameter of said free end of said second rod being greater than an outer diameter of said second end of said pipe such that said second end of pipe may be removably extended into said free end of said second rod;

a pair of bars each being movably extended into one of the ends of said first rod and frictionally engaging said first rod, each of said bars having a length generally between 12 inches and 18 inches;

a pair of caps each being removably positioned over a free end of one of said pair of bars; and a tub cover being positioned on a top edge of said peripheral wall and covering an open top side of said tub, a bottom surface of said tub cover abutting said bars such that said tub cover is supported above a central area of a plane of said open top side of said tub.

6. A tub cover support device for positioning on the bottom wall of a tub, the tub having a peripheral wall extending upwardly from bottom wall, a cover being positioned on a top edge of the peripheral wall and generally covering an open top side of the tub, the device supporting said cover above a central area of a plane of the open top side, said device including:

a foot for positioning in said tub on said bottom wall;

a pipe being generally hollow and having an open first end and open second end;

a coupler being attached to said foot and removably coupling said first end of said pipe to said foot, said coupler including;

a disc having a tubular member attached thereto and extending upwardly from a first side of said disc, said tubular member being removably extendable into said first end of said pipe;

a fastener being positioned on an bottom surface of said foot and extending upwardly through an opening in said foot for removably fastening said foot to said disc, said fastener extending through said disc and into said tubular member; and a support portion being removably coupled to said second end of said pipe, said support portion having a pair of bars extending outwardly horizontally with respect to a vertical orientation of said pipe when said support portion is coupled to said second end of said pipe, wherein said bottom surface of said cover abuts said support portion.

7. The tub cover support device as in claim 6, wherein said foot comprises a suction cup including a panel having a concave outer surface extending to a bottom edge, said panel comprising an elastomeric material, said opening in said foot extending through a central portion of said panel.

8. The tub cover support device as in claim 7, wherein said fastener comprises a screw, a nut being positioned in said tubular member and being threadably engaged with said fastener.

9. The tub cover support device as in claim 6, wherein said coupler further includes a first gasket being positioned between said disc and said foot such that said fastener extends through said first gasket, said first gasket comprising an elastomeric material.

10. The tub cover support device as in claim 9, wherein said coupler further includes a second gasket being positioned in said suction cup such that said fastener extends through said second gasket, said second gasket comprising an elastomeric material.

11. The tub cover support device as in claim 6, wherein said support portion further includes:

a bracket having a first rod attached to a second rod at a generally perpendicular orientation wherein said second rod is positioned between a pair of ends of said first rod such that said bracket generally has a T-shape, said first and second rod each having open free ends, an inner diameter of said free end of said second rod being greater than an outer diameter of said second end of said pipe such that said second end of pipe may be removably extended into said free end of said second rod;

each of said bars being movably extended into one of the ends of said first rod and frictionally engaging said first rod, each of said bars having a length generally between 12 inches and 18 inches.

* * * * *